US005478261A

United States Patent [19]

Bogese, II

[11] Patent Number: 5,478,261

[45] Date of Patent: Dec. 26, 1995

[54] MODULAR JACK FOR DIRECTLY COUPLING MODULAR PLUG WITH PRINTED CIRCUIT BOARD

[75] Inventor: Stephen B. Bogese, II, Roanoke, Va.

[73] Assignee: Virginia Patent Development Corp., Roanoke, Va.

[21] Appl. No.: 266,806

[22] Filed: Jun. 28, 1994

Related U.S. Application Data

[63] Continuation of Ser. No. 156,307, Nov. 23, 1993, abandoned, which is a continuation of Ser. No. 47,333, Mar. 18, 1993, abandoned, which is a continuation of Ser. No. 938,506, Aug. 31, 1992, abandoned, which is a continuation of Ser. No. 827,878, Jan. 19, 1992, abandoned, which is a continuation of Ser. No. 701,565, May 19, 1991, abandoned, which is a continuation of Ser. No. 590,604, Sep. 26, 1990, abandoned, which is a continuation of Ser. No. 474,244, Feb. 5, 1990, abandoned, which is a continuation of Ser. No. 364,518, Jun. 9, 1989, abandoned, which is a continuation of Ser. No. 253,957, Oct. 5, 1988, abandoned, which is a continuation of Ser. No. 139,100, Dec. 24, 1987, abandoned, which is a continuation of Ser. No. 40,730, Apr. 21, 1987, abandoned, which is a continuation of Ser. No. 882,434, Jul. 7, 1986, abandoned, which is a continuation of Ser. No. 777,865, Sep. 19, 1985, abandoned, which is a continuation of Ser. No. 527,852, Aug. 30, 1983, abandoned, which is a continuation-in-part of Ser. No. 215,054, Dec. 10, 1980, Pat. No. 4,457,570, which is a continuation-in-part of Ser. No. 120,846, Feb. 19, 1980, abandoned, which is a continuation of Ser. No. 915,457, Jun. 14, 1978, abandoned.

[51] Int. Cl.[6] ..... H01R 21/22

[52] U.S. Cl. ..... 439/676; 439/79; 439/862

[58] Field of Search ..... 439/55, 78, 79, 439/80, 81, 83, 344, 676, 862

[56] References Cited

U.S. PATENT DOCUMENTS

| | | | |
|---|---|---|---|
| 2,038,513 | 3/1936 | Hirmann | 439/701 |
| 2,876,320 | 3/1959 | Blaustein | 439/387 |
| 2,911,612 | 11/1959 | Jackson et al. | 439/637 |
| 3,193,791 | 7/1965 | Bock et al. | 439/374 |
| 3,221,288 | 11/1965 | Eads | 439/329 |
| 3,262,082 | 7/1966 | Gammel, Sr. | 439/59 |
| 3,289,146 | 11/1966 | Tuchel | 439/743 |
| 3,315,217 | 4/1967 | Bird | 439/630 |
| 3,369,214 | 2/1968 | Krumreich et al. | 439/676 |
| 3,384,864 | 5/1968 | Schwartz | 439/629 |
| 3,399,377 | 8/1968 | Warzecka | 439/634 |
| 3,835,445 | 9/1974 | Hardesty | 439/410 |
| 4,087,148 | 5/1978 | Bauerle | 439/260 |
| 4,210,376 | 7/1980 | Hughes et al. | 439/676 |
| 4,428,636 | 1/1984 | Kam et al. | 439/676 |
| 4,537,456 | 8/1985 | Brown et al. | 439/404 |
| 4,566,749 | 1/1986 | Johnston | 439/676 |

FOREIGN PATENT DOCUMENTS

| | | | |
|---|---|---|---|
| 1289899 | 2/1969 | Germany | 339/17 LC |
| 5074/64 | 5/1967 | Switzerland | 439/856 |

OTHER PUBLICATIONS

Teletape™, Undercarpet Telephone Cable, Flat Cable, Adaptors and Accessories (May 1, 1981), printed by Brand Rex Company.

*Primary Examiner*—Neil Abrams
*Attorney, Agent, or Firm*—Saidman DesignLaw Group

[57] ABSTRACT

An improved modular jack for directly coupling a modular plug to a printed circuit board. The jack features a separable cap member for retaining the conductors in the housing, a spring contact portion that extends from the rear to the front of the jack housing and includes in one embodiment a substantially linear, lower surface that greatly increases the contact area with the modular plug's contact terminal. The design of the jack's conductors, and their placement in the housing, virtually eliminates failure due to overstress, increases and optimizes the signal transfer surface area, and achieves uniform contact resistance regardless of the depth of insertion of the plug into the jack. In an alternate, bifurcated embodiment, the likelihood of vibration-triggered open circuits is substantially reduced.

53 Claims, 3 Drawing Sheets

FIG.6
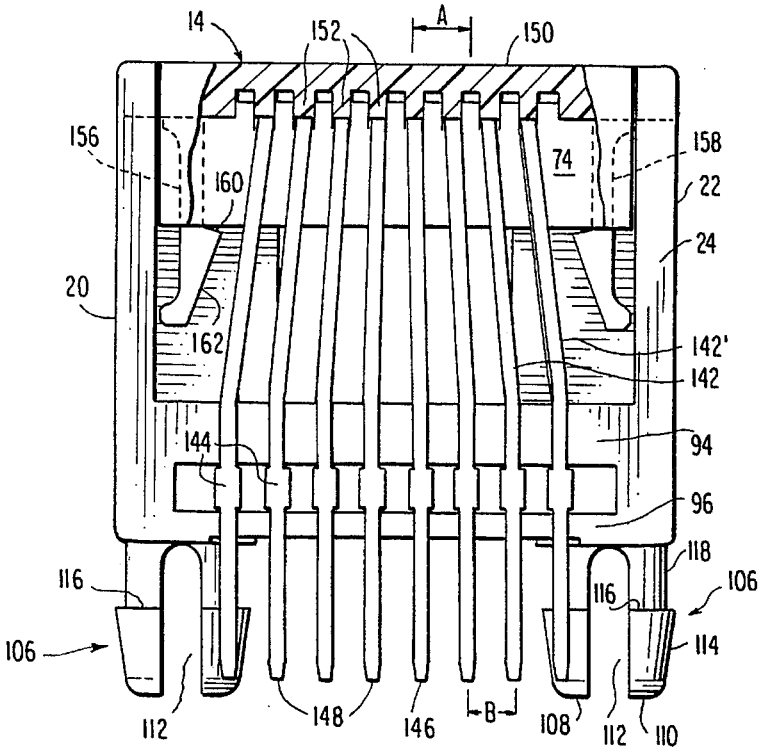
FIG.12
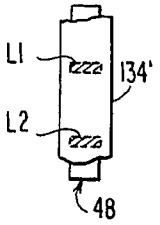
FIG.13
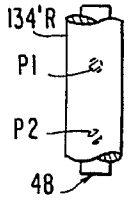
FIG.7
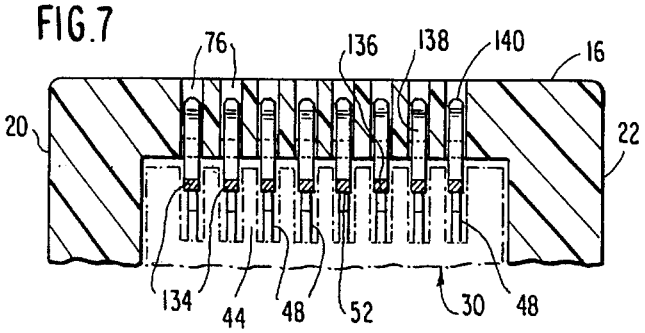
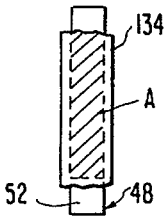
FIG.9
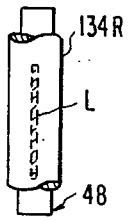
FIG.10
FIG.8
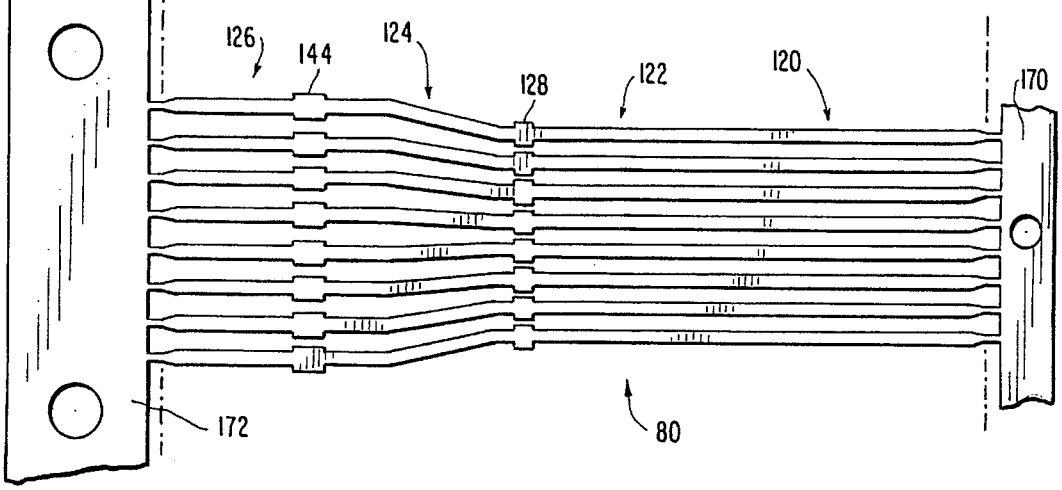

MODULAR JACK FOR DIRECTLY COUPLING MODULAR PLUG WITH PRINTED CIRCUIT BOARD

CROSS REFERENCE TO RELATED APPLICATIONS

This application is a continuation of Ser. No. 08/156,307 filed Nov. 23, 1993, now abandoned, which was a continuation of Ser. No. 08/047,333, filed Mar. 18, 1993, now abandoned, which was a continuation of Ser. No. 07/938,506, filed Aug. 31, 1992, now abandoned, which was a continuation of Ser. No. 07/827,878, filed Jan. 30, 1992, now abandoned, which was a continuation of Ser. No. 07/701,565, filed May 14, 1991, now abandoned, which was a continuation of Ser. No. 07/590,604, filed Sep. 26, 1990, now abandoned, which was a continuation of Ser. No. 07/474,244, filed Feb. 5, 1990, now abandoned, which was a continuation of Ser. No. 07/364,518, filed Jun. 9, 1989, now abandoned, which was a continuation of Ser. No. 07/253,957, filed Oct. 5, 1988, now abandoned, which was a continuation of Ser. No. 07/139,100, filed Dec. 24, 1987, now abandoned, which was a continuation of Ser. No. 07/040,730, filed Apr. 21, 1987, now abandoned, which was a continuation of Ser. No. 06/882,434, filed Jul. 7, 1986, now abandoned, which was a continuation of Ser. No. 06/777,865, filed Sep. 19, 1985, now abandoned, which was a continuation of Ser. No. 06/527,852, filed Aug. 30, 1983, now abandoned, which was a continuation-in-part of Ser. No. 215,054, filed Dec. 10, 1980, now U.S. Pat. No. 4,457,570, which was a continuation-in-part of Ser. No. 120,846, filed Feb. 12, 1980, now abandoned, which was a continuation of Ser. No. 915,457, filed Jun. 14, 1978, now abandoned.

BACKGROUND OF THE INVENTION

1. Field of the Invention

The present invention is related to electrical connectors, and more particularly is directed towards a new and improved telephone-type modular jack for directly coupling a standard, telephone-type modular plug to a printed circuit board.

2. Description of the Related Art

Electrical connectors known as modular plugs and modular jacks have recently come into widespread use in the telecommunications industry. Modular plugs and modular jacks are also widely used as general interconnect devices for a variety of types of electrical equipment. As utilized herein, the terms "modular jack" and "modular plug" connote the miniature, interchangeable, quick-connect-and-disconnect jacks and plugs developed by Western Electric Company and Bell Telephone Laboratories originally for use with telephone equipment. See, for example, U.S. Pat. Nos. 3,699,498; 3,850,497; and 3,860,316. The word "modular" came to be used with these types of plugs and jacks not because the plugs and jacks themselves were modular (in the normal sense of the word), but because they modularized the telephone equipment (handsets, desksets, cord assemblies, mounting plates, etc.) with which they were utilized, i.e. these plugs and jacks enabled the telephone equipment to be manufactured in a standardized size and design to permit interchangeability of components and custom arrangements.

Several modular jacks have been proposed for directly coupling a modular plug to a printed circuit board. See, for example, U.S. Pat. No. 4,210,376, as well as each of my prior U.S. patent applications referenced above.

In my prior U.S. application Ser. No. 120,846, now abandoned, there is described a novel modular jack particularly designed to serve as a direct interface between a standard, telephone-type modular plug and a printed circuit board. This connector jack includes a plurality of conductors formed in the connector housing. One end of the conductors extend from the rear portion of the housing in an alternating, staggered fashion so as to be easily inserted into correspondingly-spaced apertures in a printed circuit board. The extending end portions form solder posts for permitting subsequent wave-soldering to pads preformed on the printed circuit board. The remaining portions of the conductors extend through the body of the housing to the front portion thereof and are then bent rearwardly into a plug-receiving opening so as to form spring contact portions which are laterally spaced so as to correspond with the contact terminal spacing of the mating, modular plug. An important feature of the modular jack of this prior application is the provision of differential spacing between the spring contact portions of the conductors and the solder post portions of the conductors. Such differential spacing permits mating of the spring contact portions with standard modular plugs, and also permits attachment of the solder posts to CAD (computer-aided-design)-generated printed circuit boards. More particularly, and by way of example, the latter requires adjacent solder posts to be spaced 0.050 inch apart, while the Federal Communications Commission requires 0.040 inch spring contact portion spacing.

In my prior application Ser. No. 215,054, now U.S. Pat. No. 4,457,570 there is described an improved modular jack that also incorporates differential spacing. The principal feature of this improved modular jack is the provision of conductors which enter the plug-receiving cavity of the jack from the rear of the jack, rather than from the front of the jack as with previous designs. This feature results in substantial economies as a result of the reduction in required conductor length, gold plating, and the like.

While an improvement over my prior and other existing modular jack designs, the device of Ser. No. 215,054 nevertheless suffers from several deficiencies. For one thing, the particular design requires the conductors to be formed in place after insertion in the housing. This has proven to be an unduly expensive and difficult manufacturing step. In addition, ultrasonic welding is required in order to maintain the conductors in place in the housing. Ultrasonic welding, while generally effective, has not proven to be as reliable or trouble-free as might otherwise be achieved with a different design.

In addition to the foregoing, there are several problems which are indigenous to most if not all modular jacks presently on the market. One problem arises when a smaller modular plug is accidentally inserted into a larger modular jack. For example, it is physically possible, given the standard dimensions of modular plugs and jacks, to place a four or six terminal plug into an eight wire jack. Since the spring contact portions of the conductors of the jack are lined up in a horizontal row in the plug-receiving opening, what occurs when this happens is that the plastic shoulders of the smaller plug strike the outer spring contact portions of the jack. This can cause the outer spring contact portions of the jack to become overstressed, resulting in permanent damage to the jack, or requiring replacement of the jack. One solution previously proposed was to incorporate plastic lock out keys or studs in the plug-receiving opening of the jack to prevent smaller plugs from being inserted. However, it was discovered that such an arrangement still permitted the plugs to be physically forced past the keys without too much effort, thereby defeating their purpose.

Another problem common to presently known modular jacks is that the design of the spring contact portions provide only a small area of contact with the conductor terminals of the male. Presently marketed jack designs all utilize a linear, diagonally extending spring contact portion which makes contact with the crown, or radiused end, of the contact terminal of the plug. This results in essentially a point of contact approximately 0.0008 inch in diameter. Several problems arise from this configuration. For one thing, when the conductors are carrying high frequency signals (e.g., 20–40 MHz), some information can be lost due to the small area of contact (i.e., signal transfer area) between the male and female conductors.

Another problem with the generally diagonal spring contact configuration is that it does not provide a uniform contact resistance as the plug is inserted and withdrawn into and from the jack. This results from the fact that the spring contact portions have a longitudinal force vector which increases and thus creates more resistance to longitudinal movement of the plug as the plug is inserted more deeply into the plug-receiving opening of the jack. Conversely, the contact resistance lessens as the plug is withdrawn from the cavity.

A further problem with the known configuration results from the fact that only a single point or area of contact is established between the female spring contact portion and the male contact terminal. If the connectors are utilized in an environment which is subject to vibration as frequently occurs, electrical continuity may be intermittently and undesirably broken.

A further problem with known modular jack designs is that they for the most part require conductors of unequal length. It would be more desirable from a manufacturing standpoint if conductors of substantially equal length could be utilized.

OBJECTS AND SUMMARY OF THE INVENTION

The overall objectives of the present invention include the provision of an improved modular jack for directly coupling a modular plug to a printed circuit board, in which contact failure due to overstress is virtually eliminated, the signal transfer surface area between the male and female conductors is increased and optimized, uniform contact resistance is obtained regardless of the depth of insertion of the plug into the jack, the likelihood of vibration-triggered open circuits is reduced, and assembly and manufacturing simplicity are obtained.

The foregoing and other objects are achieved in accordance with one aspect of the present invention through the provision of a telephone-type modular jack for interfacing a telephone-type modular plug with a printed circuit board, which comprises a housing having a front portion, a rear portion and an outer wall. The outer wall includes means extending integrally therefrom for mounting the housing to the printed circuit board. An opening is formed in the front portion of the housing for receiving the telephone-type modular plug. The latter is characterized by having a multiconductor cord terminated by a plurality of side-by-side, substantially planar, insulation-piercing, contact terminals positioned in the forward portion thereof. The contact terminals generally include a substantially flat, elongated upper edge surface.

The opening in the jack housing is defined by an inner top wall, inner side walls, and a partition extending transversely across the rear portion of the housing and including a plurality of side-by-side conductor-receiving guide means formed therein.

There is further provided a plurality of electrical conductors arranged in a side-by-side, spaced-apart fashion in the housing. Each of the conductors include an end portion extending normally from the outer wall for insertion through a corresponding hole formed in the printed circuit board, a first intermediate portion extending through the conductor-receiving guide means in the partition, a second intermediate portion formed between the end portion and the first intermediate portion and extending across the rear portion of the housing, and a spring contact portion that extends from the first intermediate portion angularly into the opening from the rear portion of the housing towards the front portion of the housing. The spring contact portion in a preferred embodiment includes a substantially linear lower portion so that the upper edge surface of the contact terminals of the modular plug engage the linear lower portion of the spring contact portions of the conductors after insertion of the plug into the opening of the modular jack.

In one embodiment, the conductors comprise stamped and formed contacts, the linear lower portion of the spring contact portion including a substantially flat lower surface for contacting the flat upper edge surface of the contact terminal whereby the resultant contact area between the spring contact portion and the contact terminal when in normal alignment comprises a quadrilateral. In an alternate embodiment, the conductors comprise round wires whereby the resultant contact area between the spring contact portion and the contact terminal when in normal alignment comprises a substantially thin, elongated line.

In accordance with other aspects of the present invention, the spring contact portion further includes a first diagonal portion that extends between the first intermediate portion and the lower portion, the spring contact portion terminating in a free end portion. The inner top wall of the opening includes a plurality of side-by-side slot means formed in alignment with the conductor-receiving guide means. The first diagonal portion of the spring contact portions preferably extend partially within the opening and partially within the slot means. The free end portion of the spring contact portions is freely movable in the slot means upon insertion and withdrawal of the modular plug into and out of the opening of the modular jack.

In accordance with other aspects of the present invention, the angular orientation of the lower portion of the spring contact portion in the opening is such that the modular plug when inserted into the opening causes the lower portion to become substantially parallel with the longitudinal axis of the opening. Stated another way, the lower portion of the spring contact portion is oriented at a slight angle to the longitudinal axis of the opening prior to insertion of the modular plug into the opening, and becomes substantially parallel to the longitudinal axis of the opening after insertion of the modular plug into the opening.

In accordance with other aspects of the present invention, the spring contact portion preferably further includes a second diagonal portion extending between the lower portion and the free end portion. The contact terminals of the modular plug also include first and second crowns formed at the respective ends of the flat, elongated, upper edge surface. The second diagonal portion of the spring contact portion is angled in the opening to make initial contact with the forwardmost crown upon initial insertion of the contact terminal into the opening. The first crown urges the spring contact portion upwardly as the modular plug is inserted further into the opening of the modular jack.

In accordance with still other aspects of the present invention, the conductor-receiving guide means are formed on the upper surface of the partition at a height above the inner top wall of the opening. Stated another way, the first intermediate portions of the conductors (which lie in the guide means) are in a plane that is spaced above the plane of the inner top wall of the opening. More particularly, the conductor-receiving guide means comprise a plurality of side-by-side channels that extend longitudinally on the upper surface of the partition. The channels preferably include means for restraining the conductors against longitudinal movement. The restraining means, in turn, comprises a transverse set of retaining apertures formed across the channels and adapted to receive retaining tabs that are formed in the conductors at the junction of the first and second intermediate portions.

In accordance with yet further aspects of the present invention, means are also provided for preventing vertical movement of the conductors. In a preferred form, such means comprises a separable cap member adapted to be fastened to the upper surface of the partition. The cap member includes means for bearing against the retaining tabs of the conductors in the channels. The bearing means preferably takes the form of a plurality of teeth formed in the lower portion of the cap member. The forwardmost edge of the teeth define the fulcrum for the spring contact portions of the conductors during use. The cap member further preferably includes a back wall having alternating, inwardly extending teeth for bearing against the second intermediate portions of the conductors. Post means preferably extend downwardly from the cap member for insertion into post-receiving apertures formed in the partition. The cap member preferably also includes means for substantially covering those portions of the first intermediate portion of the conductors that lie rearwardly of the slot means.

In accordance with still other aspects of the present invention, rear partition means are also preferably provided and extend transversely across the lower portion of the rear portion of the housing, below the partition, and include means for retaining the end portions of the conductors in an alternating, staggered array. More particularly, the rear partition means preferably comprises an intermediate rear partition having a first set of conductor-receiving recesses extending inwardly from an outer edge thereof. Alternating recesses are relatively shallow, while the remaining recesses are relatively deep. The alternating shallow and deep recesses define the alternating, staggered pattern of the end portions of the conductors. A lower rear partition is spaced below the intermediate rear partition and includes a second set of conductor-receiving recesses which are substantially similar to and aligned with the first set. The conductors each further preferably include a retaining tab formed in the end portion thereof and sized to fit in the space between the intermediate and lower rear partitions for securing the conductors against vertical movement.

In accordance with another important aspect of the present invention, the housing further preferably includes conductor differential spacing means for causing the end portions of the conductors to extend from the outer wall in two substantially parallel rows, the end portions of any two conductors in one row being laterally spaced from each other a distance greater than the corresponding spring contact portions of the same two conductors.

In accordance with another embodiment of the present invention, the spring contact portion, instead of comprising a substantially linear lower portion, includes at least two separate contact regions that engage the upper edge surface of the contact terminals of the plug. The spring contact portion may, for example, be arranged in a W-configuration so that the lowermost portions contact the flat upper edge surface of the contact terminals. When the conductors comprise stamped and formed flat contacts, the resultant contact area between a spring contact portion and a contact terminal when in normal alignment comprises a pair of spaced, parallel lines extending transversely to the longitudinal axis of the opening. Alternatively, when the conductors comprise round wires, the resultant contact area between a W-shaped spring contact portion and a contact terminal when in normal alignment comprises a pair of spaced points, a line through which would be substantially parallel with the longitudinal axis of the opening.

BRIEF DESCRIPTION OF THE DRAWINGS

The foregoing and other objects, aspects, features and advantages of the present invention will be more fully appreciated as the same becomes better understood from the following detailed description of the present invention when considered in connection with the accompanying drawings, in which:

FIG. 6 is a rear view in elevation of the preferred embodiment of the present invention;

FIG. 7 is a sectional view illustrating the mating of the male and female conductors, taken along line 7—7 of FIG. 1;

FIG. 8 is a plan view of a portion of a sheet metal strip illustrating the stamping and forming of the conductor strips utilized in the present invention;

FIG. 9 is an enlarged, schematic representation showing the contact area established between the male and female conductors in one embodiment of the present invention;

FIG. 10 is similar to FIG. 9 but illustrates an alternate construction;

FIGS. 12 and 13 illustrate resultant contact areas between the male and female utilizing the alternate embodiment of FIG. 11.

DETAILED DESCRIPTION OF THE PREFERRED EMBODIMENTS

Figure 1:
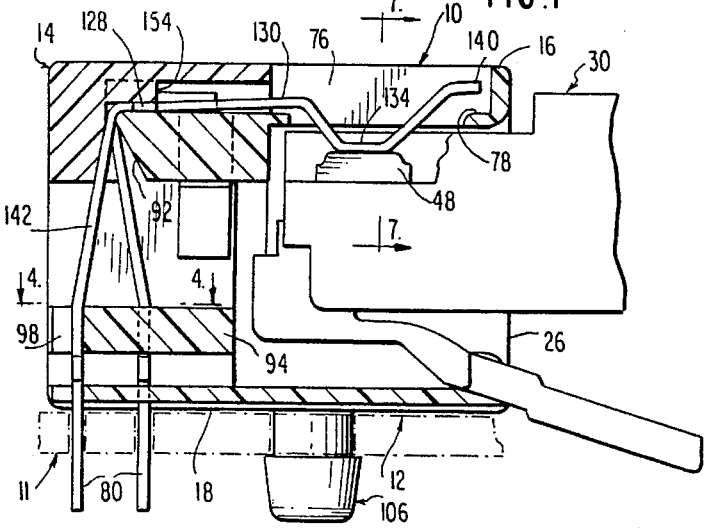
FIG. 1 is a longitudinal sectional view illustrating a preferred embodiment of the modular jack of the present invention with a mated modular plug in position.

Referring now to the drawings, wherein like reference numerals represent identical or corresponding parts throughout the several views, and more particularly to FIG. 1, the modular jack of the present invention is indicated generally by reference numeral 10.

Modular jack 10 is designed to be mounted directly onto a printed circuit board shown in dotted outline in FIG. 1 by reference numeral 11. Printed circuit board 11 may be characterized by the provision of a plurality of holes (not shown) formed in a standard, alternating, staggered or triangular pattern to receive the perpendicularly extending end portions of the conductors 80 of jack 10, to be described in greater detail hereinafter. Printed circuit board 11 is also provided with a pair of larger holes (not shown) which are sized to receive a pair of mounting posts or feet indicated generally by reference numeral 106 which extend from the outer bottom wall 18 of modular jack 10.

Referring briefly to FIG. 6, it may be appreciated that mounting posts 106 each comprise a pair of substantially mirror-image post halves 108 and 110 separated by a longitudinal slot 112 that permits halves 108 and 110 to flex inwardly towards one another. Each half 108 and 110 includes a constant diameter main body portion 118 whose length is approximately equal to the thickness of the printed circuit board (PCB). Formed on the end of each main body portion 118 is a tapered tip 114 which rearwardly terminates in a retaining ledge 116. The holes for receiving posts 106 are sized slightly larger than the overall outer diameter of main body portions 118. When inserting post 106 through the hole in the PCB, slot 112 permits post halves 108 and 110 to flex towards one another. Tapered tips 114 facilitate insertion. When the tips 114 are fully inserted through the holes, the halves 108 and 110 will snap back outwardly to their normal position, and ledge 116 will serve as a retaining member to hold the posts in position.

Referring back to FIG. 1, the modular jack 10 generally comprises a unipartite, integral dielectric housing indicated generally by reference numeral 12, and a separable cap member indicated generally by reference numeral 14. Cap member 14 will be described in greater detail hereinafter.

Referring now to FIGS. 1–4, dielectric housing 12 includes a top outer wall 16, a bottom outer wall 18, outer side walls 20 and 22, an outer rear wall 24, and a front wall 26. Extending rearwardly from front wall 26 is a plug-receiving cavity or opening 28 which is particularly designed and sized to receive a mating modular plug indicated generally by reference numeral 30.

Modular plug 30 is of the type generally described, for example, in the following U.S. Pat. Nos.: 3,860,316; 3,954,320; 3,998,514; and 4,002,392, the disclosures of which are expressly incorporated herein by reference.

Figure 2:
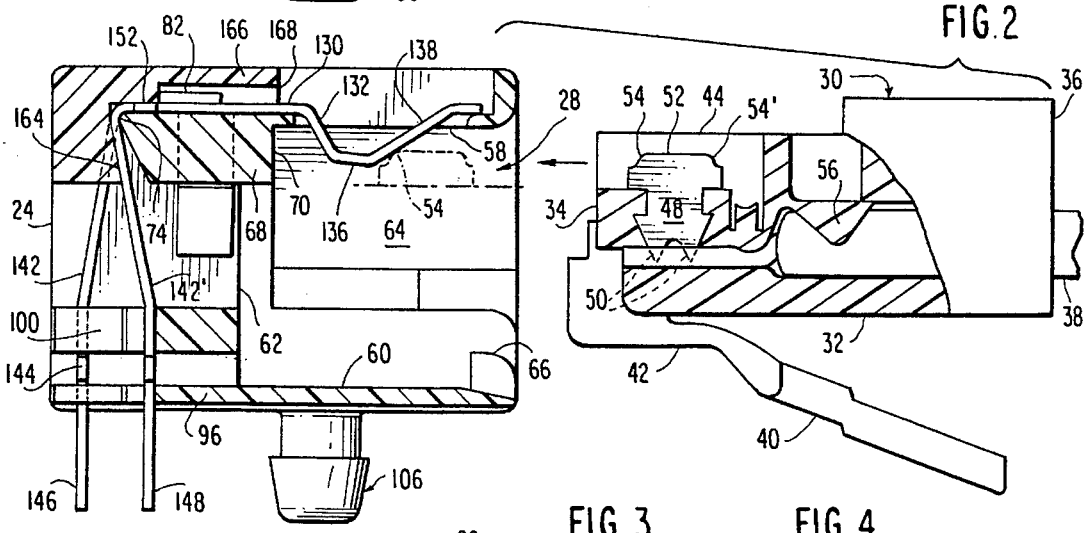
FIG. 2 is another longitudinal sectional view of the preferred embodiment of the present invention but prior to the insertion of the modular plug.
Figure 3:
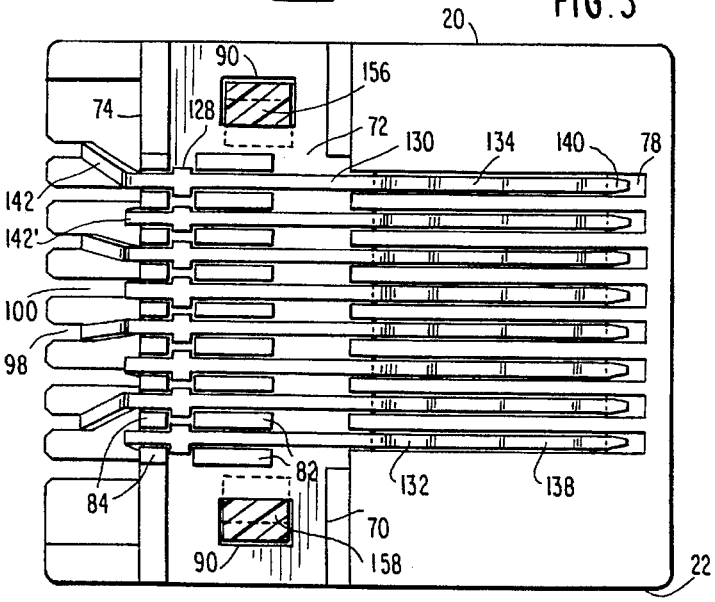
FIG. 3 is an enlarged top view of the preferred embodiment of FIGS. 1 and 2, shown with the cap removed.

Referring particularly to FIG. 2, telephone-type modular plug 30 is generally characterized by a dielectric housing 32 having a free end 34 for insertion into modular jack 10. Plug 30 also includes a cord input end 36 having a cavity formed therein for receiving a multi-conductor cord 38. Modular plug 30 is further characterized by the provision of a resilient locking tab 40 integrally connected to the free end 34 of housing 32 by a flexible hinge 42. Locking tab 40 extends obliquely rearwardly from the free end 34.

Plug housing 32 is further characterized by a terminal receiving side 44 having a plurality of parallel partitions formed therein that define side-by-side slots. Each slot is particularly designed to receive and retain a substantially flat, conductive, generally phosphor-bronze plated contact terminal 48. Contact terminal 48 is, in turn, characterized by a pair of insulation-piercing tangs 50 which extend from the lower portion thereof for piercing the insulation and making contact with an insulated wire of multi-conductor cord 38. Contact terminal 48 is further characterized by an upper, generally flat, elongated edge surface 52 which, in the present invention, serves as the external contact portion for modular plug 30. Edge surface 52 is generally rectangular (approximately 0.077 inch long and 0.012 inch wide) and is defined on both sides by the generally parallel side walls of the contact 48, and a pair of curved portions or crowns 54 and 54' formed one at each end of flat edge surface 52. The forwardmost crown 54 is formed at a predetermined radius and is adapted to make initial contact with the conductors of the jack, as will be described in greater detail hereinafter. Modular plug 30 may also be provided with a retaining bar 56, as is conventional, which serves as a strain relief mechanism for multi-conductor cord 38.

Referring again to FIGS. 1–3, plug-receiving cavity 28 is defined by an inner top wall 58, an inner bottom wall 60, an inner rear wall 62, and opposed, inner side walls 64. Bottom wall 60 preferably includes in the forward portion thereof a locking tab 66 for retaining latching arm 40 in the conventional manner (FIG. 1).

Extending through the inner top wall 58 to the outer top wall 16 are a plurality of side-by-side, parallel slots 76 which are adapted to receive and align the forward portions of a plurality of side-by-side conductors which are indicated generally by reference numeral 80 in FIG. 5 and which will be described in greater detail hereinafter. Each slot 76 includes a lip 78 that extends rearwardly from the forward wall 26. Slots 76 themselves extend from the forward wall 26 rearwardly to an upper, rear partition indicated generally by reference numeral 68.

Figure 5:
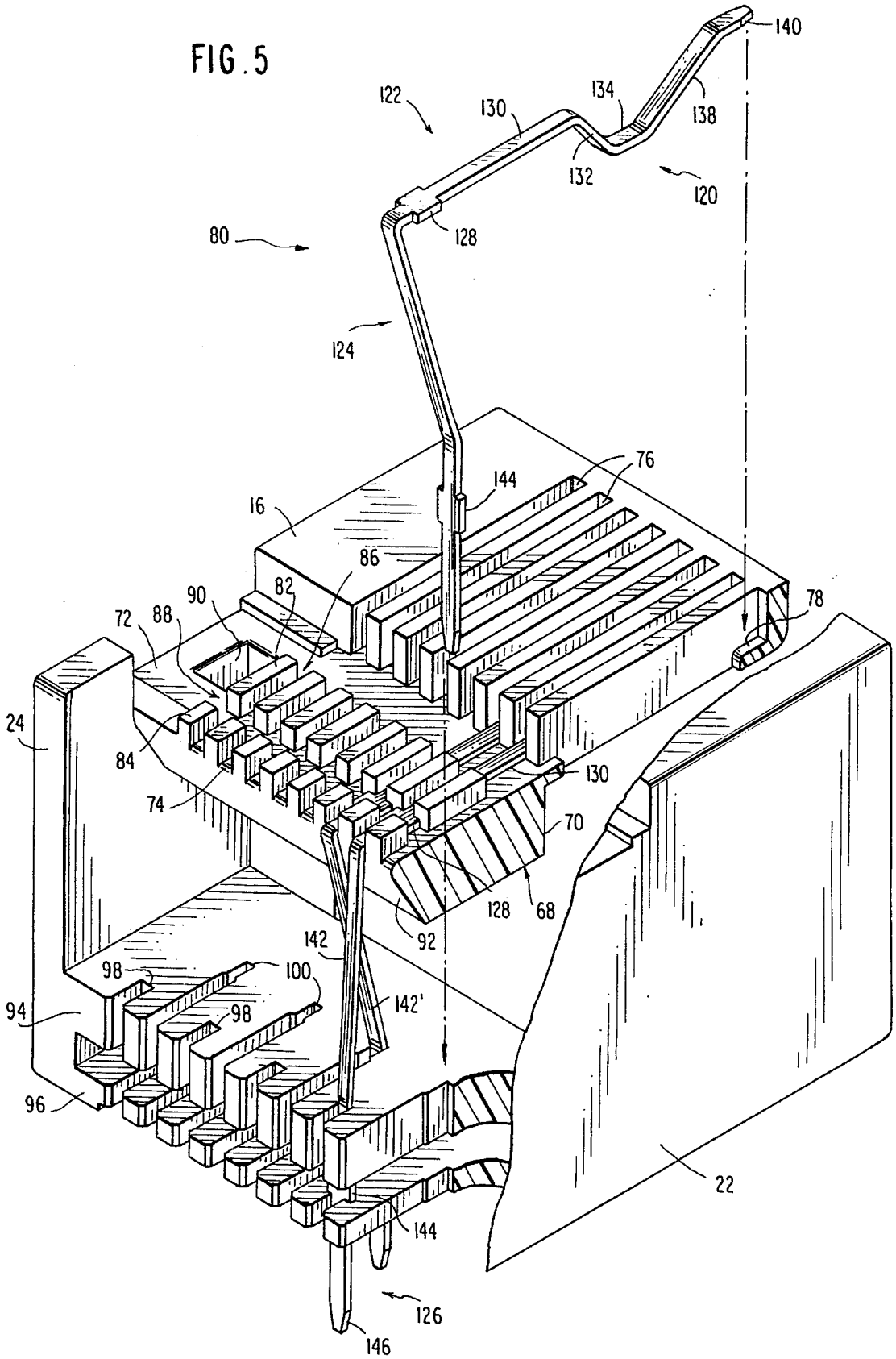
FIG. 5 is an enlarged, perspective, cut-away, partially exploded view of the preferred embodiment of the modular jack of the present invention, shown without the cap member.

As seen best in FIGS. 1, 2 and 5, upper, rear partition 68 extends across the rear portion of the plug-receiving cavity 28 between inner side walls 64 and defines an intermediate rear wall 70, a recessed top wall 72, and a rear edge 74. Intermediate rear wall 70 serves as a barrier against which the free end 34 of modular plug 30 abuts when fully inserted into plug receiving cavity 28. The recessed top wall 72 is a support surface against which the conductors 80 are seated in a manner to be described in greater detail hereinafter. The rear edge 74 of partition 68 is curved and also serves as a bearing surface over which the conductors 80 extend.

Formed on the recessed top wall 72 of partition 68 are a plurality of forward spacers or fins 82 that are aligned with the walls that form slots 76. A plurality of rear spacers or fins 84 are aligned with forward spacers 82 on top wall 72. Spacers 82 and 84 together define a plurality of side-by-side guide channels 86 that extend longitudinally on top wall 72. The gap between forward and rear spacers 82 and 84 defines a plurality of transversely extending retaining apertures 88 whose purpose will become more clear hereinafter.

Also located on the recessed top wall 72 of partition 68, on each side of spacers 82, are a pair of recesses 90 that serve to receive and retain the mounting arms of cap 14. Partition 68 also includes an inwardly extending rear surface 92 shaped to accommodate those portions of conductors 80 which extend over the rear portion of the housing in a manner to be described.

As perhaps best viewed in FIG. 5, extending from the plug receiving cavity 28 rearwardly is an intermediate rear partition 94 below which is positioned a similar, spaced, lower rear partition 96. Partitions 94 and 96 each include alternating shallow and deep recesses 98 and 100, respectively, both sets of which extend inwardly from outer rear wall 24. The openings to recesses 98 and 100 are beveled as at 102 and 104 (FIG. 4) to facilitate entry of conductors 80 to the narrower, internal portions of recesses 98 and 100 which maintain the conductors in place via a frictional fit.

Referring now to FIGS. 1, 2, and particularly FIG. 5, each conductor 80 is seen to include a spring contact portion 120, an intermediate retention portion 122, a differential spacing portion 124, and a solder post portion 126. In the preferred embodiment of FIG. 5, conductors 80 comprise stamped and formed contacts, although it will be understood that drawn round wires could also be utilized.

The intermediate retention portion 122 of conductor 80 includes a substantially square retaining tab 128 which is sized to fit within retaining apertures 88 on recessed top wall 72 of partition 68. The forward and rear edges of retaining tabs 128, when properly positioned in apertures 88, prevent forward and rearward longitudinal movement of conductors 80.

Intermediate retention portion 122 further includes a substantially linear moment arm 130 that extends forwardly from tab 128. The junction between tab 128 and arm 130 importantly defines the fulcrum point for spring contact portion 120, as will become more clear hereinafter. Moment arms 130 of conductors 80 fit within the longitudinal guide channels 86 on top wall 72 and serve to laterally stabilize and align the conductors 80. As seen in FIG. 2, arms 130 preferably extend from tabs 128 forwardly to a position just inside slots 76.

Spring contact portion 120 of conductor 80 is defined by a first diagonal leg 132 that extends from arm 130 angularly downwardly and forwardly into plug-receiving cavity 28 to a position below inner top wall 58. Extending forwardly from leg 132, and slightly downwardly when unstressed (FIG. 2) is a linear lower portion 134 whose lower surface 136 serves as the contact surface for mating with the contact terminal 48 of modular plug 30. In the preferred embodiment, wherein the conductors 80 comprise stamped and formed contacts, the bottom surface 136 is substantially flat and elongated and is adapted to mate with the flat, linear top surface 52 of terminal 48. This substantially increases the contact area therebetween when compared with previously known designs, in a manner to be described in greater detail hereinafter.

Spring contact portion 120 further includes a second diagonally extending leg 138. Leg 138 is formed at a shallow enough angle so that it is initially engaged by forwardmost crown 54 of contact terminal 48 as the latter is inserted into plug-receiving opening 28 (see dotted outline in FIG. 2). Diagonal leg 138 terminates in the free end 140 of conductor 80 which is angled horizontally, substantially parallel with arm 130, and is adapted to rest in repose on lip 78.

Differential spacing portion 124 of conductor 80 includes, as viewed in FIG. 6, divergent, non-parallel rear portions 142, 142', that extend over the rear edge 74 of upper rear partition 68 downwardly to the top of intermediate rear partition 94. As is apparent from FIGS. 1 and 2, portions 142 extend diagonally rearwardly from rear edge 74 of partition 68, while portions 142' extend diagonally forwardly from rear edge 74. This design permits each of the conductors 80 to advantageously be substantially the same length. As viewed in FIG. 6, the uppermost portions of differentially spaced portions 124 are separated by a distance A which is shorter than the distance B by which their lowermost portions are separated. Typically, distance A is approximately 0.040 inch, while distance B is 0.050 inch, the former corresponding to FCC requirements for the contact terminals in a telephone-type modular plug, the latter being compatable with CAD (computer-aided-design)-generated printed circuit board layout equipment. Arms 130 and spring contact portions 120 are also separated by an inter-conductor distance A, while solder post portions 126 are laterally separated by distance B.

Figure 4:
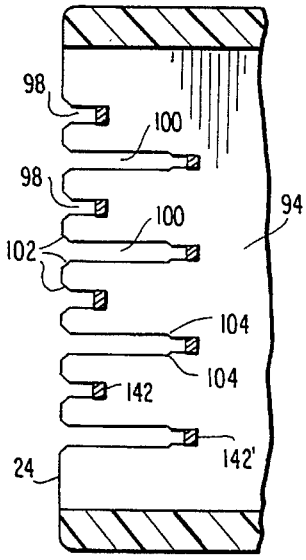
FIG. 4 is a partial sectional view taken along line 4—4 of FIG. 1.

Divergent rear portions 142 are located in shallow recesses 98 of partitions 94 and 96, while divergent rear portions 142' are located in deep recesses 100 of partitions 94 and 96, as seen in FIG. 4.

Conductors 80 become parallel to each other again when they enter recesses 98 and 100 of intermediate rear partition 94 to form solder post portions 126. Solder post portions 126 include a second series of retaining tabs 144 (FIGS. 5 and 6) which are sized to fit between rear partitions 94 and 96. Retaining tabs 144 serve to limit vertical movement of conductors 80, especially during insertion of the solder post portions 126 through corresponding holes formed in the printed circuit board.

Solder post portions 126 extend below lower rear partition 96 to form two parallel rows of contacts 146 and 148 arranged in an alternating, staggered or triangular pattern.

As seen in FIGS. 1, 2 and 6, cap 14 is a separately molded part that is preferably constructed of a softer, more flexible plastic than that of main housing 12 of modular jack 10. Cap 14 comprises a main body portion 150 from the underside of which extends a plurality of retaining teeth 152. Teeth 152 are sized and aligned to come into contact with and seat on that portion of conductors 80 which extends from the forward edge of tab 128 rearwardly. The forward edge of teeth 152 define a fulcrum edge or point 154 for the moment arms 130 as the latter are bent upon insertion and removal of modular plug 30. Cap 14 futher includes side mounting arms 156 and 158 (FIG. 6). Arms 156 and 158 include a snap-in retaining wedge 160 which is guided into place by tapered edge 162 for easy installation into tab-retention holes 90 in the recessed top wall 72 of partition 68. Arms 156 and 158 upon insertion are designed to bend outwardly and snap into position once wedges 160 extend below holes 90.

Cap 14 further includes a rear wall structure having alternating inwardly tapered teeth 164 (FIG. 2) as a projecting surface to assist in preventing undesired rearward movement of portions 142' of conductors 80.

Finally, cap 14 extends forwardly over moment arms 130 with a cover portion 166 to provide protection for the underlying conductors. Additionally, the forward edge 168 (FIG. 2) of cover portion 166 of cap 14 serves as a second fulcrum edge or point for moment arms 130 in the unlikely event that the latter are bent sufficiently by, for example, insertion of an oversized object into cavity 28. This second or "safety" fulcrum 168 limits overstressing of the main fulcrum 154 of moment arms 130.

In the assembly of the modular jack of the present invention, conductors 80 are provided as illustrated in FIG. 8 in sheet metal form, stamped between a pair of carrier strips 170 and 172. Initially, spring contact portion 120 of conductors 80 are formed by a forming tool, and then a 90 degree bend is made just rearwardly of retaining tabs 128 by another forming tool. Conductors 80 are then severed from forward strip 170. The partially formed conductors 80 are then placed into housing 12 as a unit, and are snapped into place by initially fitting tabs 128 into slots 88 (FIG. 5). Thereafter, strip 172 is severed, and tabs 144 are pushed into position between partitions 94 and 96. Cap 14 is then snapped into place into holes 90 of upper rear partition 68, after which the unit is ready for use. Advantageously, all forming steps of conductors 80 are performed prior to insertion of the conductors into the housing, and the retaining tabs 128 and 144, together with cap member 14, perform the necessary longitudinal and vertical retention functions without requiring ultrasonic welding or the like.

It is noted in FIG. 2 that the linear bottom surface 136 of spring contact portion 120 of conductor 80 is angled slightly downwardly from the rear to the front of cavity 28 prior to entry of plug 30 into cavity 28. The angle may be, for example, approximately 5 degrees with respect to the longitudinal axis of opening 28. This design ensures that portion 136 will rest in maximum contact with the flat upper surface 52 of contact terminal 48 of plug 30 after full insertion of plug 30 into opening 28.

Upon initial insertion of plug 30 into opening 28, crown 54 makes contact with diagonal 138 as described above. It is important that crown 54 initially contact diagonal 138, and not the sharp edge below crown 54, because the gently radiused edge of crown 54 will not scratch or mar the gold plating of conductor 80. Upon further insertion of plug 30, crown 54 serves to raise spring contact portion 120 by pivoting against the fulcrum formed by edge 154 of cap 14. Intermediate portion 130 serves as the moment arm for the spring contact portion 120. Further insertion of plug 30 raises spring contact portion 120 until its flat bottom surface 136 is in mating engagement with the flat top surface 52 of contact terminal 48, as shown in FIG. 1. In this position, moment arm 130 is slightly raised off the top wall 72 of rear partition 68, and free end 140 is raised off the lip 78 of slot 76.

FIG. 7 is a cross-sectional view illustrating the mating condition of the flat portions 134 of the spring contacts 120 and the flat portions 52 of the contact terminals 48 in an eight conductor jack and plug assembly. The width or thickness of the flat spring contact portion 134 is approximately 0.017 inch in a preferred embodiment, while the width or thickness of the contact terminal at edge 52 is approximately 0.012 inch in the preferred embodiment. Thus, as seen better in FIG. 9, the area of intersection A between edge 52 and edge 136, when the components are in normal alignment, approximates a quadrilateral figure—in this case, a rectangle. The contact area A is substantially increased over the point contact provided by previous designs. By "normal alignment", it is meant that the longitudinal axis of the spring contact portion lies substantially parallel to the longitudinal axis of the cavity 28 which, in turn, is substantially parallel with the plane formed by contact terminal 48. Of course, contact terminal 48 and/or spring contact portion 120 may be angled or skewed with one another during use, which could create a somewhat irregular area of contact between the two, as may be appreciated. However, in most instances, the resultant area of contact will be substantially greater than the single point contact areas of previously known designs.

FIG. 10 illustrates an alternate configuration wherein the stamped and formed contact portion 134 is replaced by a drawn, round wire 134R. In this instance, the area of contact, in normal alignment, will be defined by a line L, which, although less than area A of FIG. 9, is nevertheless a substantial improvement over known contact areas.

Figure 11:
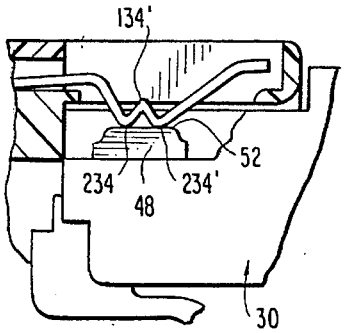
FIG. 11 is a partial sectional view, similar to FIG. 1, but illustrating an alternate spring contact configuration for the present invention.

Referring now to FIG. 11, an alternate arrangement for the spring contact portion 120 is illustrated which provides two separate contact regions 234 and 234'. One way of achieving two contact regions is by shaping the spring contact portion 120 in a bifurcated or W-configuration 134'. With this arrangement, and with the conductor made from a flat, stamped and formed contact, the resultant areas of contact with contact terminal 48 are shown in FIG. 12. As seen therein, two parallel spaced lines L1 and L2 result, which lines are substantially perpendicular to the longitudinal axis of cavity 28 in normal alignment.

In the event that the conductor of FIG. 11 is made from a drawn, round wire, two points of contact P1 and P2 result, as shown in FIG. 13.

The lines and points of contact of FIGS. 12 and 13, resulting from a bifurcated spring contact portion, while not providing as great of a contact area as that illustrated in FIGS. 9 and 10, are nevertheless improvements over previously known devices and provide backup integrity against vibration failure of the single point contact prevalent today.

It may be appreciated by virtue of the foregoing that there has been described a distinct improvement over presently available modular jacks for directly coupling a modular plug to a printed circuit board. Particularly, the point of flexure of the spring contact portion of the conductors of the present invention resides above the point of contact and above the plug-receiving opening. Thus, if a smaller plug is accidentially inserted into cavity 28 and strikes one of the spring contacts, the latter, while being flexed upwardly, cannot be overstressed, due to the high placement of the moment arm. Only the mating surface of the spring contact portion and its leads are exposed below the guide slots and ceiling of the plug receiving cavity of the connector, the point of flexure being totally enclosed and protected in the housing.

Additionally, a substantially uniform contact resistance is achieved with the present invention since the spring contact portion mates on the top, linear and horizontal surface of the contact terminal of the male regardless of its particular position within the female.

Furthermore, the flattened bottom of the spring contact portion, in the preferred embodiment, provides a substantially rectangular or quadrilateral area of contact with the male blade, which, in turn, provides a better transfer window for high frequency signals. The bifurcated contact embodiment provides greater resistance to vibration failure since it is less likely that both points or areas of contact will break at the same time.

The present invention is also advantageous in that the contact members can be provided in substantially the same length, owing to a unique arrangement of the differentially spaced portions at the rear of the housing. The overall height of the jack of the present invention has been minimized (for non-side mounted latching arms) to permit use within multiboard racks having as little as 0.50 inch spacing therebetween.

Numerous modifications and variations of the present invention are possible in light of the above teachings. It is therefore to be understood that within the scope of the appended claims, the invention may be practiced otherwise than as specifically described herein.

I claim as my invention:

1. A telephone-type modular jack for interfacing a telephone-type modular plug with a printed circuit board, which comprises:

a housing having a front portion, a rear portion, an outer wall, and means for mounting said housing to the printed circuit board;

an opening formed in said front portion of said housing for receiving the telephone-type modular plug having a multi-conductor cord terminated by a plurality of side-by-side, substantially planar, insulation-piercing, contact terminals positioned in the forward portion of the plug, said contact terminals including a substantially flat, elongated upper edge surface, said opening defined by an inner top wall and inner side walls, a partition extending transversely across said rear portion of said housing and including an upper surface and a plurality of side-by-side conductor-receiving guide means formed therein; and a plurality of electrical conductors arranged in a side-by-side, spaced-apart fashion in said housing, each of said conductors including an end portion extending normally from said outer wall for insertion through a corresponding hole formed in the printed circuit board, a first intermediate portion extending in said conductor-receiving guide means in said partition, a second intermediate portion formed between said end portion and said first intermediate portion and located in said rear portion of said housing, a spring contact portion extending from said first intermediate portion into said opening from said rear portion of said housing towards said front portion of said housing and including a substantially linear lower portion;

said upper edge surface of said contact terminals of said telephone-type modular plug engaging said linear lower portion of said spring contact portions of said conductors resulting in an elongated area of contact therebetween, and said spring contact portion and said first intermediate portion of said conductors being pivoted upwardly about a fulcrum upon insertion of said telephone-type modular plug into said opening of said telephone-type modular jack.

2. The modular jack of claim 1, wherein said conductors comprise stamped and formed contacts, said linear lower portion of said spring contact portion including a substantially flat lower surface for contacting said flat upper edge surface of said contact terminal, whereby the resultant contact area between said spring contact portion and said contact terminals when in normal alignment comprises a quadrilateral.

3. The modular jack of claim 1, wherein said conductors comprise round wires, said linear lower portion of said spring contact portion including a rounded outer surface for contacting said flat upper edge surface of said contact terminals, whereby the resultant contact area between said spring contact portion and said contact terminal when in normal alignment comprises a substantially thin, elongated line.

4. The modular jack of claim 1, wherein said spring contact portion further includes a first diagonal portion and a free end portion, said first diagonal portion extending between said first intermediate portion and said lower portion, said spring contact portion terminating in said free end portion.

5. The modular jack of claim 4, wherein said inner top wall of said opening includes a plurality of side-by-side slot means formed in alignment with said conductor-receiving guide means, said first diagonal portions of said spring contact portions extending partially within said opening and partially within said slot means.

6. The modular jack of claim 5, wherein said free end portion of said spring contact portion is freely movable in said slot means upon insertion and withdrawal of the modular plug into and out of said opening of the modular jack.

7. The modular jack of claim 1, wherein the angular orientation of said lower portion of said spring contact portion in said opening is such that the modular plug when inserted into said opening causes said lower portion to become substantially parallel with the longitudinal axis of said opening.

8. The modular jack of claim 1, wherein said lower portion of said spring contact portion is oriented at a slight angle to the longitudinal axis of said opening prior to insertion of the modular plug into said opening.

9. The modular jack of claim 8, wherein said lower portion of said spring contact portion is substantially parallel to the longitudinal axis of said opening after insertion of the modular plug into said opening.

10. The modular jack of claim 4, wherein said spring contact portion further includes a second diagonal portion extending between said lower portion and said free end portion.

11. The modular jack of claim 10, wherein:

said contact terminals of said modular plug further include at least a first crown formed at one end of said flat, elongated, upper edge surface;

said second diagonal portion of said spring contact portion angled in said opening to make initial contact with said first crown upon insertion of said contact terminal into said opening;

said first crown urging said spring contact portion upwardly as the modular plug is inserted further into said opening of the modular jack.

12. The modular jack of claim 1, wherein said conductor-receiving guide means are formed on the upper surface of said partition at a height above said inner top wall of said opening.

13. The modular jack of claim 1, wherein said first intermediate portions of said conductors lie in a plane which is spaced above the plane of said inner top wall of said opening.

14. The modular jack of claim 1, wherein said conductor-receiving guide means comprises a plurality of side-by-side channels extending longitudinally on the upper surface of said partition.

15. The modular jack of claim 14, wherein said channels include means for restraining said conductors against longitudinal movement therein.

16. The modular jack of claim 15, wherein said restraining means comprises a transverse set of retaining apertures formed across said channels and adapted to receive retaining tabs formed in said conductors at the junction of said first and second intermediate portions.

17. The modular jack of claim 16, further comprising means for preventing vertical movement of said conductors.

18. The modular jack of claim 17, wherein said vertical movement preventing means comprises a separable cap member adapted to be fastened to said upper surface of said partition, said cap member including means for beating against said first intermediate portion of said conductors in said channels.

19. The modular jack of claim 18, wherein said bearing means comprises a plurality of teeth formed in the lower potion of said cap member the forwardmost edge of said teeth defining a fulcrum for said spring contact potions of said conductors during

20. The modular jack of claim 18, wherein said cap member includes a back wall having a projecting surface for beating against said second intermediate portions of said conductors.

21. The modular jack of claim 18, wherein said cap member includes post means extending downwardly therefrom for insertion into post-receiving apertures formed in said partition.

22. The modular jack of claim 1, further comprising rear partition means extending transversely across the lower portion of said rear portion of said housing, below said partition, and including means for retaining said end portions of said conductors in an alternating, staggered array.

23. The modular jack of claim 22, wherein said rear partition means comprises:

an intermediate rear partition having a first set of conductor-receiving recesses extending inwardly from an outer edge thereof, alternating recesses being relatively shallow, the remaining recesses being relatively deep; and a lower rear partition spaced below said intermediate rear partition and including a second set of conductor-receiving recesses substantially similar to and aligned with said first set.

24. The modular jack of claim 23, wherein said conductors each further include a retaining tab formed in said end portion and sized to fit in the space between said intermediate and lower rear partitions for securing said conductors against vertical movement.

25. The modular jack of claim 1, further comprising conductor differential spacing means in said housing for causing said end portions of said conductors to extend from said outer wall in two substantially parallel rows, the end portions of any two conductors in one row being laterally spaced from each other a distance greater than the corresponding spring contact portions of the same two conductors.

26. The modular jack of claim 1, wherein said fulcrum is located on said first intermediate portion of said conductors.

27. The modular jack of claim 1, wherein said fulcrum is located near the junction of said first and second intermediate portions of said conductors.

28. The modular jack of claim 1, wherein:

said contact terminals of said modular plug further include a first crown formed at the forwardmost end of said flat, elongated, upper edge surface;

said spring contact portion further includes a free end and an angular portion extending between said linear lower portion and said free end;

said angular portion of said spring contact portion making initial contact with said first crown upon insertion of said modular plug into said opening;

said first crown urging said spring contact portion upwardly as the modular plug is inserted further into said opening of the modular jack.

29. The modular jack of claim 1, wherein said electrical conductors have a substantially uniform cross-sectional area from one end thereof to the other.

30. The modular jack of claim 1, wherein said elongated area of contact between said linear portion and said contact terminals comprises a quadrilateral.

31. The modular jack of claim 1, wherein, prior to insertion of said plug into said jack, said first intermediate portion of said conductors normally rests on said upper surface of said partition and is lifted off of said upper surface upon insertion of said plug into said jack.

32. The modular jack of claim 31, wherein that portion of said first intermediate portion that lifts off said partition comprises a moment arm having one end acting as said fulcrum.

33. A telephone-type modular jack for interfacing a telephone-type modular plug with a printed circuit board, which comprises:

a housing having a front portion, a rear portion, an outer wall, and means for mounting said housing to the printed circuit board;

an opening formed in said front portion of said housing for receiving the telephone-type modular plug having a multi-conductor cord terminated by a plurality of side-by-side, substantially planar, insulation-piercing, contact terminals positioned in the forward portion of the plug, said contact terminals including a substantially flat, elongated upper edge surface, said opening defined by an inner top wall and inner side walls, a partition extending transversely across said rear portion of said housing and including a plurality of side-by-side conductor-receiving guide means formed therein;

a plurality of electrical conductors arranged in a side-by-side, spaced-apart fashion in said housing, each of said conductors including an end portion extending normally from said outer wall for insertion through a corresponding hole formed in the printed circuit board, a first intermediate portion extending in said conductor-receiving guide means in said partition, a second intermediate portion formed between said end portion and said first intermediate portion and extending across said rear portion of said housing, and a spring contact portion extending from said first intermediate portion into said opening from said rear portion of said housing towards said front portion of said housing and including a substantially linear lower portion;

said upper edge surface of said contact terminals of said telephone-type modular plug engaging said linear lower portion of said spring contact portions of said conductors after insertion of said telephone-type modular plug into said opening of said telephone-type modular jack;

further comprising means for preventing vertical movement of said conductors;

wherein said vertical movement preventing means comprises a separable cap member having a pair of mounting posts for insertion into apertures formed in said partition, said cap member including means for bearing against the top of said conductors in said guide means, said bearing means including a forwardmost edge that defines a fulcrum point for said spring contact portions of said conductors during use.

34. The modular jack of claim 33, wherein said inner top wall of said opening includes a plurality of side-by-side slot means formed in alignment and forwardly of said conductor-receiving guide means, said first intermediate portion of said conductors extending into said slot means from said guide means.

35. The modular jack of claim 34, wherein said cap member includes means for substantially covering those portions of said first intermediate portions of said conductors that lie rearwardly of said slot means.

36. The modular jack of claim 33, wherein said cap member further includes a back wall having alternating, inwardly extending teeth for bearing against said second intermediate portions of said conductors.

37. A modular jack for directly coupling to a printed circuit board a modular plug of the type which includes a dielectric housing having a free end for insertion into the modular jack, a cord input end having a cavity for receiving a multi-conductor cord, a resilient locking tab integrally connected by a flexible hinge to the free end of the dielectric housing and extending obliquely rearwardly therefrom, a terminal-receiving side having partitions which define side-by-side slots in communications with the cavity, electrically conductive contact terminals positioned within the slob and extending into the cavity for making electrical engagement with associated conductors of the cord and for making electrical contact external to the plug, the contact terminals including insulation-piercing tangs at the lower portion thereof and a substantially flat upper edge surface on at least one end of which is formed a crown, the modular jack comprising:

(a) an insulating housing having a front end, a rear end, and a plurality of external walls;

(b) plug-receiving cavity means for receiving the modular plug extending into said front end of said insulating housing and having a plurality of internal walls;

(c) solder post means extending from said rear end of said insulating housing for insertion through alternating, staggered holes formed in the printed circuit board;

(d) a partition wall extending adjacent the rear portion of said plug-receiving cavity means and having conductor-receiving means formed therein;

(e) a plurality of electrical conductors in side-by-side spaced-apart relationship in said housing, each of said conductors comprising:

(i) an intermediate portion located in said conductor-receiving means of said partition wall;

(ii) a spring contact portion extending from said intermediate portion into said plug-receiving cavity means from said rear potion of said plug-receiving cavity means towards said front end of said insulating housing, all of said conductors in said housing having substantially identical spring contact portions; and (iii) an end portion extending perpendicularly beyond one of said external walls to form said solder post means;

(f) said spring contact portions of said conductors including a substantially linear lower surface for engaging the flat upper edge surface of the contact terminals of the modular plug resulting in an elongated area of contact therebetween upon insertion of the plug into said plug-receiving cavity means; and (g) said plug-receiving cavity means further having recess means formed in one of said internal walls for receiving and releasably retaining the locking tab of the modular plug.

38. A modular jack as set forth in claim 37, further comprising conductor differential spacing means in said insulating housing for causing said end portions of said conductors to extend from said one external wall in two substantially parallel rows, the end portions of any two conductors in one row being laterally spaced from each other a distance greater than the corresponding spring contact portions of the same two conductors.

39. The modular jack of claim 37, wherein said conductors comprise stamped and formed contacts, said linear lower portion of said spring contact portion including a substantially flat lower surface for contacting said flat upper edge surface of said contact terminal, whereby the resultant contact area between said spring contact portion and said contact terminals when in normal alignment comprises a quadrilateral.

40. The modular jack of claim 37, wherein said conductors comprise round wires, said linear lower portion of said spring contact portion including a rounded outer surface for contacting said flat upper edge surface of said contact terminals, whereby the resultant contact area between said spring contact portion and said contact terminal when in normal alignment comprises a substantially thin, elongated line.

41. The modular jack of claim 37, wherein:

said crown is formed at the forwardmost end of said flat upper edge surface of said contact terminal;

said spring contact portion further includes a free end and an angular portion extending between said linear lower surface and said free end;

said angular portion of said spring contact portion making initial contact with said crown upon insertion of said modular plug into said plug-receiving cavity means;

said crown urging said spring contact portion upwardly as the modular plug is inserted further into said plug-receiving cavity means of the modular jack.

42. The modular jack of claim 37, wherein said electrical conductors have a substantially uniform cross-sectional area from one end thereof to the other.

43. A modular jack for directly coupling to a printed circuit board a modular plug of the type which includes a dielectric housing having a free end for insertion into the modular jack, a cord input end having a cavity for receiving a multi-conductor cord, a resilient locking tab integrally connected by a flexible hinge to the free end of the dielectric housing and extending obliquely rearwardly therefrom, a terminal-receiving side having partitions which define side-by-side slots in communication with the cavity, electrically conductive contact terminals positioned within the slots and extending into the cavity for making electrical engagement with associated conductors of the cord and for making electrical contact external to the plug, the contact terminals including insulation-piercing tangs at the lower portion thereof and a substantially flat upper edge surface on at least one end of which is formed a crown, the modular jack comprising:

(a) an insulating housing having a front end, a rear end, and a plurality of external walls;

(b) plug-receiving cavity means for receiving the modular plug extending into said front end of said insulating housing and having a plurality of internal walls;

(c) solder post means extending from said rear end of said insulating housing for insertion through alternating, staggered holes formed in the printed circuit board;

(d) a partition wall extending adjacent the rear portion of said plug-receiving cavity means and having an upper surface and conductor-receiving means formed therein;

(e) a plurality of electrical conductors in side-by-side spaced-apart relationship in said housing, each of said conductors comprising:

(ii) an intermediate portion extending in said conductor-receiving means of said partition wall;

(ii) a spring contact portion extending from said intermediate portion into said plug-receiving cavity means from said rear portion of said plug-receiving cavity means towards said front end of said insulating housing; and (iii) an end portion extending perpendicularly beyond one of said external walls to form said solder post means;

(f) said spring contact potions of said conductors including at least two separate contact regions for engaging the flat upper edge surface of the contact terminals of the modular plug, and said spring contact portion and said intermediate portion of said conductors being pivoted upwardly about a fulcrum, upon insertion of the plug into said plug-receiving cavity means and wherein prior to insertion of said plug into said jack, said intermediate portion of said conductors normally rests on said upper surface of said partition wall and is lifted off of said upper surface upon insertion of said plug into said jack; and (g) said plug-receiving cavity means further having recess means formed in one of said internal walls for receiving and releasably retaining the locking tab of the modular plug.

44. The modular jack of claim 43, further comprising conductor differential spacing means in said insulating housing for causing said end portions of said conductors to extend from said one external wall in two substantially parallel rows, the end portion of any two conductors in one row being laterally spaced from each other a distance greater than the corresponding spring contact portions of the same two conductors.

45. The modular jack of claim 43, wherein said conductors comprise stamped and formed contacts, said spring contact portion arranged in a W-configuration the lowermost portions of which contact said flat upper edge surface of said contact terminal, whereby the resultant contact area between said spring contact portion and said contact terminal when in normal alignment comprises a pair of spaced, parallel lines extending transversely to the longitudinal axis of said opening.

46. This modular jack of claim 43, wherein said conductors comprise round wires, said spring contact portion arranged in a W-configuration the lowermost portions of which contact said flat upper edge surface of said contact terminal, whereby the resultant contact area between said spring contact portion and said contact terminal when in normal alignment comprises a pair of spaced points, a line through which would be substantially parallel with the longitudinal axis of said opening.

47. The modular jack of claim 43, wherein said fulcrum is located on said intermediate portion of said conductors.

48. A telephone-type modular jack for interfacing a telephone-type modular plug with a printed circuit board, which comprises:

a housing having a front portion, a rear portion, an outer wall, and means for mounting said housing to the printed circuit board;

an opening formed in said front portion of said housing for receiving the telephone-type modular plug having a multi-conductor cord terminated by a plurality of side-by-side, substantially planar, insulation-piercing, contact terminals positioned in the forward portion of the plug, said contact terminals including at least one crown formed at the forwardmost end of the upper portion thereof, said crown having an upper surface adjacent thereto, said opening defined by an inner top wall and inner side walls, a partition extending transversely across said rear portion of said housing and including an upper surface and a plurality of side-by-side conductor-receiving guide means formed therein;

a plurality of electrical conductors arranged in a side-by-side, spaced-apart fashion in said housing, each of said conductors including an end portion extending normally from said outer wall for insertion through a corresponding hole formed in the printed circuit board, a first intermediate portion in said conductor-receiving guide means in said partition, a second intermediate portion formed between said end portion and said first intermediate portion and extending across said rear portion of said housing, a spring contact portion extending from said first intermediate portion into said opening from said rear portion of said housing towards said front portion of said housing and including a free end, a substantially linear lower portion, and an angular portion extending between said linear lower portion and said free end;

said angular portion of said spring contact portion making initial contact with said crown upon insertion of said modular plug into said opening, said crown urging said spring contact portion upwardly as the modular plug is inserted further into said opening of the modular jack;

said upper surface of said contact terminals of said telephone-type modular plug engaging said linear lower portion of said spring contact portions of said conductors upon full insertion of said telephone-type modular plug into said opening of said telephone-type modular jack.

49. The modular jack of claim 48, wherein said conductors comprise stamped and formed contacts, said linear lower portion of said spring contact portion including a substantially flat lower surface for contacting said upper surface of said contact terminals.

50. The modular jack of claim 48, wherein said conductors comprise round wires, said linear lower portion of said spring contact portion including a rounded outer surface for contacting said upper surface of said contact terminals.

51. The modular jack of claim 48, further comprising conductor differential spacing means in said housing for causing said end portions of said conductors to extend from said outer wall in two substantially parallel rows, the end portion of any two conductors in one row being laterally spaced from each other a distance greater than the corresponding spring contact portions of the same two conductors.

52. A telephone-type modular jack for interfacing a telephone-type modular plug with a printed circuit board, which comprises:

a housing having a front portion, a rear portion, an outer wall, and means for mounting said housing to the printed circuit board;

an opening formed in said front portion of said housing for receiving the telephone-type modular plug having a multi-conductor cord terminated by a plurality of side-by-side, substantially planar, insulation-piercing, contact terminals positioned in the forward portion of the plug, said contact terminals including a substantially flat, elongated upper edge surface, said opening defined by an inner top wall and inner side walls, a partition extending transversely across said rear portion of said housing and including an upper surface and a plurality of side-by-side conductor-receiving guide means formed therein;

a plurality of electrical conductors arranged in a side-by-side, spaced-apart fashion in said housing, each of said conductors including an end portion extending normally from said outer wall for insertion through a corresponding hole formed in the printed circuit board, a first intermediate portion extending in said conductor-receiving guide means in said partition, a second intermediate portion formed between said end portion and said first intermediate portion and extending across said rear portion of said housing, and a spring contact portion extending from said first intermediate portion into said opening from said rear portion of said housing towards said front portion of said housing, said spring contact portion including a free end, a substantially linear lower portion, and an angular portion extending between said linear lower portion and said free end, said linear lower portion oriented at a slight angle to the longitudinal axis of said opening prior to insertion of the modular plug into said opening; and said upper edge surface of said contact terminals of said telephone-type modular plug engaging said linear lower portion of said spring contact portions of said conductors upon insertion of said telephone-type modular plug into said opening of said telephone-type modular jack to bring said linear lower portion substantially parallel to said longitudinal axis of said opening.

53. The modular jack of claim 52, wherein:

said contact terminals of said modular plug further include a first crown formed at the forwardmost end of said flat, elongated, upper edge surface;

said angular portion of said spring contact portion is angled in said opening to make initial contact with said first crown upon insertion of said modular plug into said opening;

said first crown urging said spring contact portion upwardly as the modular plug is inserted further into said opening of the modular jack.

* * * * *